US011069468B2

(12) United States Patent
Fujita et al.

(10) Patent No.: US 11,069,468 B2
(45) Date of Patent: Jul. 20, 2021

(54) COMMON MODE CHOKE COIL AND MANUFACTURING METHOD THEREFOR

(71) Applicant: Panasonic Intellectual Property Management Co., Ltd., Osaka (JP)

(72) Inventors: Tomohiro Fujita, Osaka (JP); Yuji Yasuoka, Osaka (JP); Kenji Ueno, Fukui (JP); Yoshiko Higashi, Osaka (JP); Tsutomu Inuduka, Osaka (JP); Kazuhiro Okuda, Osaka (JP); Ryohei Harada, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 293 days.

(21) Appl. No.: 16/309,109

(22) PCT Filed: Jun. 23, 2017

(86) PCT No.: PCT/JP2017/023120
§ 371 (c)(1),
(2) Date: Dec. 11, 2018

(87) PCT Pub. No.: WO2018/029998
PCT Pub. Date: Feb. 15, 2018

(65) Prior Publication Data

US 2019/0333675 A1 Oct. 31, 2019

(30) Foreign Application Priority Data

Aug. 9, 2016 (JP) ..... JP2016-156196

(51) Int. Cl.
*H01F 17/04* (2006.01)
*H01F 27/29* (2006.01)
(Continued)

(52) U.S. Cl.
CPC ..... *H01F 17/04* (2013.01); *H01F 27/29* (2013.01); *H01F 41/0233* (2013.01); *H01F 2017/0093* (2013.01)

(58) Field of Classification Search
CPC ..... H01F 17/04; H01F 27/29; H01F 41/0233; H01F 2017/0093; H01F 27/263; H01F 27/2828; H01F 17/045; H01F 27/292
See application file for complete search history.

(56) References Cited

U.S. PATENT DOCUMENTS 6,373,366 B1 * 4/2002 Sato ..... H01F 17/045 336/192
8,044,753 B2 * 10/2011 Azuma ..... H01F 17/045 336/83

(Continued)

FOREIGN PATENT DOCUMENTS

JP 2003-168611 6/2003
JP 2005-322820 11/2005

(Continued)

OTHER PUBLICATIONS

International Search Report of PCT application No. PCT/JP2017/023120 dated Sep. 5, 2017.

*Primary Examiner* — Mang Tin Bik Lian
(74) *Attorney, Agent, or Firm* — McDermott Will and Emery LLP

(57) ABSTRACT

An object of the present disclosure is to provide a common mode choke coil with high impedance and small variation. A common mode choke coil includes magnetic core having winding core part and a pair of flange parts provided on opposite ends of winding core part, external electrodes formed on each of flange parts, a pair of windings wound on winding core part, with each of the ends being drawn out and joined to one of external electrodes, and magnetic plate joined to the pair of flange parts with adhesive. Magnetic (Continued)

plate has joining parts joined to flange parts and opposing part opposing winding core part, and surface roughness of joining parts is smaller than surface roughness of opposing part.

4 Claims, 5 Drawing Sheets

(51) Int. Cl.
*H01F 41/02* (2006.01)
*H01F 17/00* (2006.01)

(56) References Cited

U.S. PATENT DOCUMENTS

2003/0071704 A1* 4/2003 Toi ..... H01F 17/045 336/83
2004/0263285 A1* 12/2004 Suzuki ..... H03H 7/427 333/181
2006/0145800 A1* 7/2006 Dadafshar ..... H01F 27/2847 336/82
2007/0063804 A1* 3/2007 Watanabe ..... H01F 3/10 336/83
2012/0133469 A1* 5/2012 Tomonari ..... H01F 27/292 336/192
2016/0155561 A1* 6/2016 Takagi ..... H01F 27/2823 336/222
2016/0247627 A1* 8/2016 Baker ..... H01F 27/346
2017/0025212 A1 1/2017 Jerez et al.
2017/0178775 A1 6/2017 Noguchi et al.

FOREIGN PATENT DOCUMENTS

JP 2006-100697 A 4/2006
JP 2009-224649 10/2009
JP 2009-231547 10/2009
WO 2015/135703 9/2015
WO 2016/010099 A1 1/2016

* cited by examiner

COMMON MODE CHOKE COIL AND MANUFACTURING METHOD THEREFOR

CROSS-REFERENCE TO RELATED APPLICATIONS

This application is a U.S. national stage application of the PCT International Application No. PCT/JP2017/023120 filed on Jun. 23, 2017, which claims the benefit of foreign priority of Japanese patent application No. 2016-156196 filed on Aug. 9, 2016, the contents all of which are incorporated herein by reference.

FIELD OF THE INVENTION

The present disclosure relates to a common mode choke coil having a core and a wire, and particularly relates to a common mode choke coil that is preferably used in a common mode filter for removing noise.

DESCRIPTION OF THE RELATED ART

Conventionally, it has been known to use a winding type common mode choke coil as a measure against unnecessary radiation noise in a power line, or as a measure against common mode noise in a high frequency signal.

Such a common mode choke coil of a conventional technique is constituted of a ferrite magnetic core having flange parts formed on opposite sides of a winding core, wires constituted of a plurality of insulated copper wires wound by several turns to several tens of turns in bifilar form or the like on the winding core of the magnetic core, and a magnetic plate having substantially the same permeability as that of the magnetic core and joining both the flange parts of the magnetic core with an adhesive. The magnetic core and the magnetic plate can be obtained by mixing a binding agent with ferrite powder, and pressing and sintering the mixture thereof. Further, a plurality of electrodes are formed on one or both of the flange parts, and winding start ends of the wires and winding finish ends of the wires are conductively connected to the electrodes by soldering or thermo-compression. In such a common mode choke coil, a desired impedance value is obtained by appropriately setting a number of windings of the wires to be wound on the winding core of the core.

Incidentally, as prior art document information related to the invention of this application, for example, PTL1 is known.

CITATION LIST

Patent Literature

PTL1: Unexamined Japanese Patent Publication No. 2003-168611

SUMMARY OF THE INVENTION

However, because the magnetic core and the magnetic plate are joined with an adhesive, variation in impedance value tends to occur due to a joining state thereof. Especially because sintered bodies are used for the magnetic core and the magnetic plate, variation in impedance value tends to occur due to warping or the like during sintering.

In order to solve the above-described problems, the invention related to the present disclosure is a common mode choke coil including a magnetic core having a winding core part and a pair of flange parts provided on opposite ends of the winding core part, external electrodes formed on each of the flange parts, a pair of windings wound on the winding core part, with each of the ends being drawn out and joined to one of the external electrodes, and a magnetic plate joined to the pair of flange parts with an adhesive, and has following characteristics. Specifically, the magnetic plate has joining parts joined to the flange parts and an opposing part opposing the winding core part, and surface roughness of the joining parts is smaller than surface roughness of the opposing part.

With the above configuration, a common mode choke coil with small warping of a magnetic plate and with high impedance and small variation can be obtained.

DETAILED DESCRIPTION OF THE PREFERRED EMBODIMENTS

Hereinafter, a common mode choke coil in one exemplary embodiment of the present disclosure will be explained with reference to drawings.

Figure 1:
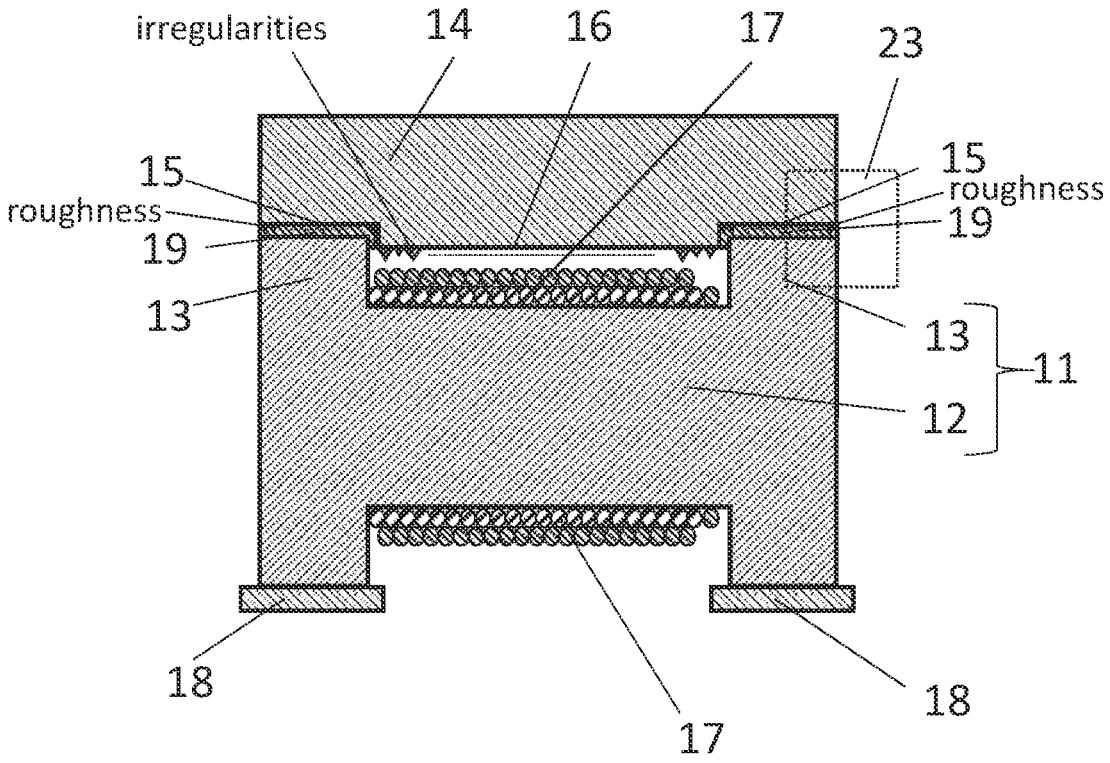
FIG. 1 is a cross-sectional view of a common mode choke coil in one exemplary embodiment of the present disclosure.
Figure 2:
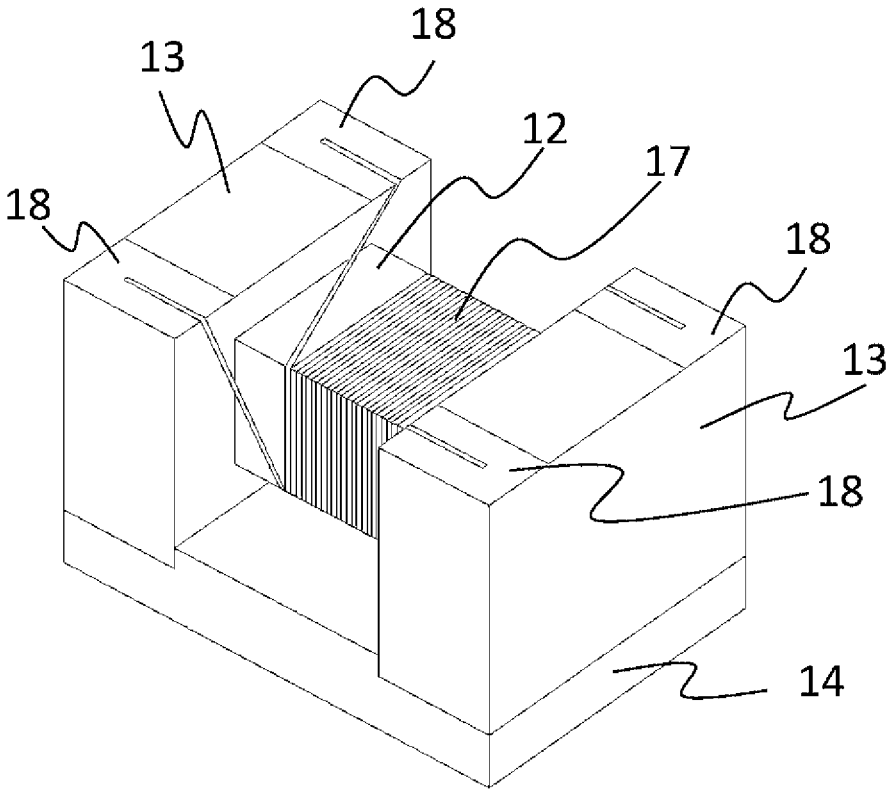
FIG. 2 is a perspective view of the common mode choke coil in one exemplary embodiment of the present disclosure.
Figure 3:
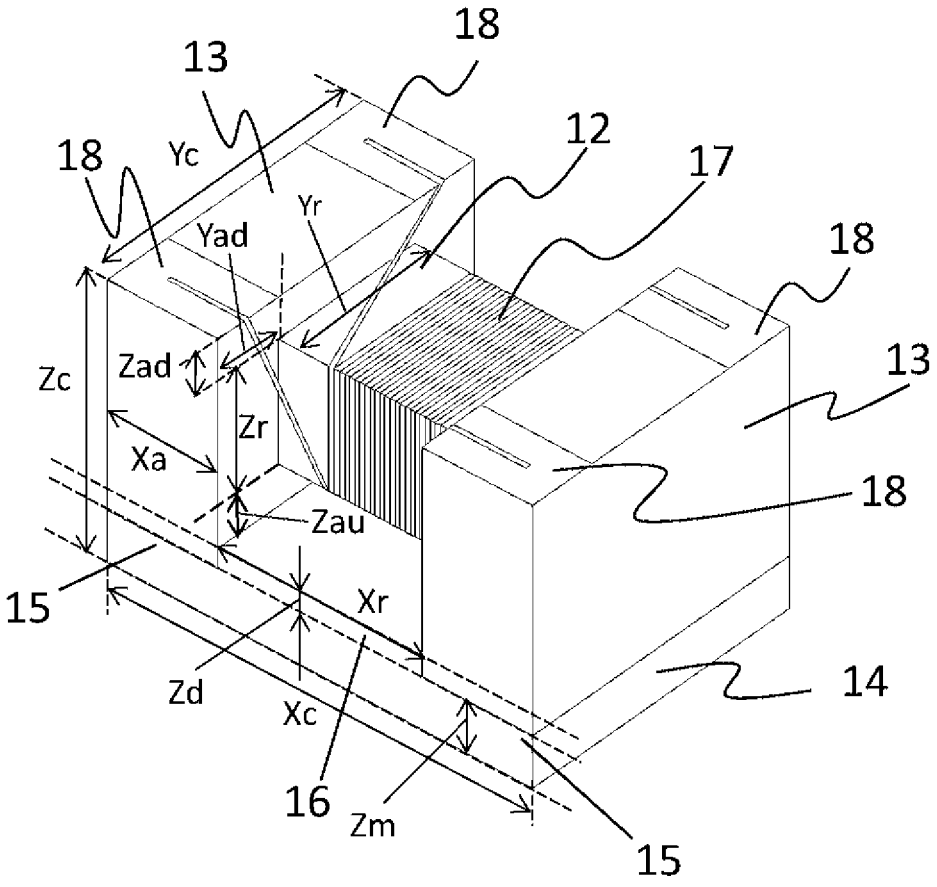
FIG. 3 is a perspective view illustrating dimensions of the common mode choke coil in one exemplary embodiment of the present disclosure.
Figure 4:
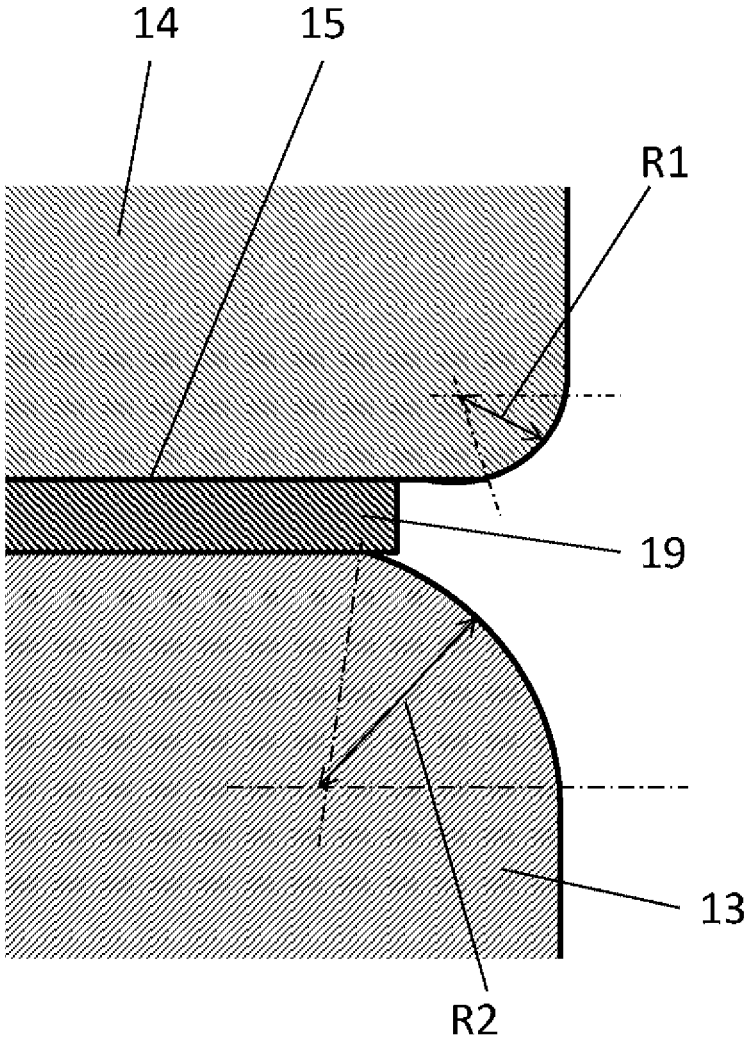
FIG. 4 is a partially enlarged cross-sectional view of the common mode choke coil in one exemplary embodiment of the present disclosure.

FIG. 1 is a cross-sectional view of the common mode choke coil in one exemplary embodiment of the present disclosure, and FIG. 2 is a perspective view of the common mode choke coil. FIG. 3 is a perspective view illustrating dimensions of the common mode choke coil. FIG. 4 is a partially enlarged cross-sectional view in region 23 of the common mode choke coil illustrated in FIG. 1. Magnetic core 11 includes winding core part 12 and a pair of flange parts 13 provided on opposite ends of winding core part 12, and winding 17 is formed by winding a pair of insulation coated wires in bifilar form on winding core part 12. Ends of each of the wires are electrically connected to external electrodes 18 provided on flange parts 13.

To upper parts of the pair of flange parts 13, magnetic plate 14 is joined with adhesive 19. A part of magnetic plate 14 that is joined to flange part 13 will be referred to as joining part 15, and a part between joining parts 15 that opposes winding core part 12 will be referred to as opposing part 16.

Dimensions of the common mode choke coil include length Xc of approximately 4.5 mm (in a winding core direction), width Yc of approximately 3.2 mm, and height Zc of approximately 2.8 mm. Further, dimensions of winding core part 12 include length Xr of approximately 2.9 mm, width Yr of approximately 2.5 mm, and height Zr of approximately 1.4 mm. Thickness Zm of opposing part 16 of magnetic plate 14 is approximately 0.6 mm, and joining parts 15 are thinner than opposing part 16 by approximately 0.04 mm due to having a step (Zd=0.04 mm). Further, flange parts 13 have length Xa of approximately 0.8 mm in the winding core direction. Winding core part 12 is provided to be approximately 0.35 mm inside of ends of flange parts 13 in a width direction (Yc=0.35 mm), and to be approximately 0.55 mm inside in a height direction (Zad=0.55 mm). Further, winding core part 12 is disposed at approximately 0.51 mm away from magnetic plate 14 (Zau=0.51 mm).

Surface roughness of joining parts 15 is approximately 1.6 μm as Ra, and surface roughness of opposing part 16 is approximately 4.7 μm as Ra, the surface roughness of the opposing part being made larger than the surface roughness of the joining parts. Here, Ra is measured with a laser microscope having a laser wavelength of 408 nm and output of 0.9 W, with a 10X objective lens, at a focal distance of 16.5 mm.

By thus making the surface roughness of joining parts 15 small, a flow of magnetic flux from flange parts 13 is increased to improve an inductance value, and by making the surface roughness of opposing part 16 larger than the surface roughness of joining parts 15, magnetic plate 14 becomes less susceptible to warping. When warping of the magnetic plate varies, easiness of flowing of magnetic flux from flange parts 13 to magnetic plate 14 varies, which causes large variation in inductance value. On the other hand, the configuration of the present exemplary embodiment enables to obtain a common mode choke coil by which a sufficient inductance value with small variation can be achieved.

As illustrated in FIG. 4, radius of curvature R1 of corners of magnetic plate 14 that oppose flange parts 13 is approximately 0.05 mm, and radius of curvature R2 of corners of flange parts 13 that oppose magnetic plate 14 is approximately 0.15 mm. By thus making the radius of curvature of corners of magnetic plate 14 that oppose flange parts 13 smaller than the radius of curvature of corners of flange parts 13 that oppose joining part 15, variation in inductance value can be made small even when a position of magnetic plate 14 is slightly displaced with respect to a position of magnetic core 11.

Figure 5:
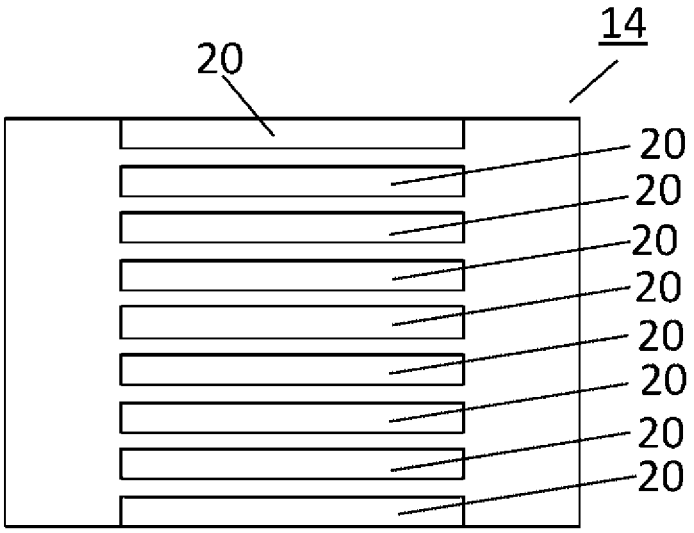
FIG. 5 is a bottom view of another magnetic plate used in the common mode choke coil in one exemplary embodiment of the present disclosure.

As illustrated in FIG. 5, in a face of opposing part 16 of magnetic plate 14 that opposes winding core part 12, a plurality of trenches 20 extending in an extending direction of winding core part 12 may be provided. Here, trenches 20 are provided at pitches of approximately 0.2 mm and with depth of approximately 0.05 mm. When a strain in a twisting direction occurs in the magnetic plate, variation in inductance value easily occurs, but providing such trenches makes the strain in a twisting direction difficult to occur, and further makes the inductance value stable.

Note that, as illustrated in FIG. 1, it is more desirable to provide magnetic plate 14 with steps between joining parts 15 and opposing part 16, and to join upper faces of flange parts 13 and joining parts 15 and side faces of opposing part 16 and flange parts 13 with adhesive 19. In this manner, joining strength between magnetic core 11 and magnetic plate 14 can be further increased.

As adhesive 19, it is more desirable to use an adhesive in which magnetic powder is mixed with resin. By using adhesive 19 mixed with magnetic powder and disposing adhesive 19 between the side faces of opposing part 16 and flange parts 13, the inductance value can be further improved.

Next, a manufacturing method for the common mode choke coil in one exemplary embodiment of the present disclosure will be explained.

Magnetic core 11 includes winding core part 12 and a pair of flange parts 13 provided on opposite ends of this winding core part 12, and can be obtained by mixing a binder with ferrite powder, and pressing and sintering the mixture thereof. On winding core part 12, winding 17 is formed by winding a pair of conducting wires with an insulation coating in bifilar form. Ends of each conducting wire are electrically connected to external electrodes 18 provided on flange parts 13. To upper parts of the pair of flange parts 13, magnetic plate 14 is joined with adhesive 19.

In order to produce magnetic plate 14, ferrite powder is dispersed in an organic solvent containing a binder to make slurry, and the slurry is molded in sheet form, thereby obtaining a ferrite green sheet. A thickness of the ferrite green sheet is approximately 0.1 mm. Eight such ferrite green sheets are stacked and subjected to main pressing, so as to have a thickness of approximately 0.7 mm. This stacked body is cut in a predetermined shape, and subsequently sintered, thereby obtaining an individual piece of magnetic plate 14. At this time, a thickness of a center portion is approximately 0.6 mm.

Here, in opposing part 16 of magnetic plate 14 that opposes winding core part 12, irregularities are made by subjecting to main pressing using a stamper. In this stamper, surface roughness in Ra at positions for forming joining parts 15 of magnetic plate 14 to be joined to flange parts 13 is approximately 2.1 μm, and surface roughness in Ra at a position for forming opposing part 16 between joining parts 15 that opposes winding core part 12 is approximately 3.6 μm. This stamper has a part of a stainless plate with a mirror surface that is etched using a ferric chloride solution, so as to increase surface roughness of the etched surface. That is, etching is performed on a stainless plate corresponding to the position for forming opposing part 16 between joining parts 15 that opposes winding core part 12, and the other part is left as the mirror surface. After magnetic plate 14 is subjected to main pressing with this stamper and sintering, surface roughness in Ra of joining parts 15 is approximately 1.6 μm, and surface roughness in Ra of opposing part 16 is approximately 4.7 μm. When magnetic plate 14 produced in this manner and a magnetic plate produced by pressing and subsequent sintering as in a conventional manner are compared, warping of magnetic plate 14 produced according to the present exemplary embodiment results in a warping level difference less than or equal to half a warping level difference resulted from conventional pressing, and in small variation thereof.

When the magnetic plate is produced by pressing, it is inevitable to chamfer corners in order to improve a pulling property from a die. On the other hand, in magnetic plate 14 of the present exemplary embodiment, the radius of curvature of corners can be made small because the magnetic plate is produced by stacking and main pressing, and subsequent cutting and sintering of a ferrite green sheet. By thus making the radius of curvature of corners of magnetic plate 14 that oppose flange parts 13 smaller than the radius of curvature of corners of flange parts 13 that oppose the magnetic plate, variation in inductance value can be made small even when a position of the magnetic plate is slightly displaced with respect to a position of the magnetic core.

Figure 6:
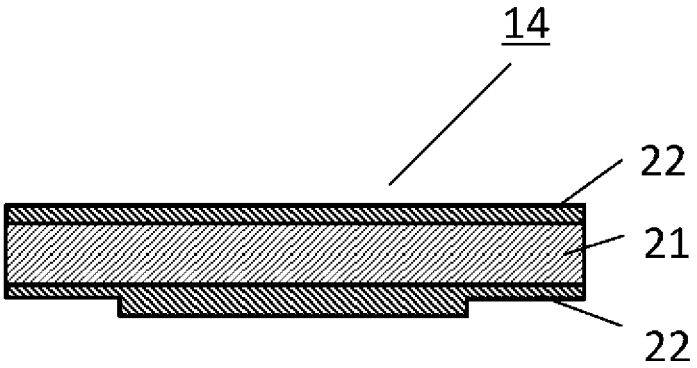
FIG. 6 is a cross-sectional view of still another magnetic plate used in the common mode choke coil in one exemplary embodiment of the present disclosure.

Further, because magnetic plate 14 is constituted of a stacked body, the stacked body may be constituted of a combination of different sheets as illustrated in FIG. 6. For example, on upper and lower faces of magnetic sheet 21 having a thickness of approximately 0.4 mm and a first grain size with an average grain diameter of approximately 1.0 μm, magnetic sheets 22 having a thickness of approximately 0.2 mm and a second grain size with an average grain diameter of approximately 0.5 μm may be stacked, so as to produce magnetic plate 14. In this manner, magnetic plate 14 with smaller variation in warping can be obtained.

Note that with respect to the common mode choke coil according to the present exemplary embodiment, dimensions of winding core part 12, flange parts 13, magnetic plate 14, and so on are not limited to the above-described dimensions, and can take various values depending on application of the common mode choke coil.

A common mode choke coil and a manufacturing method therefor according to the present disclosure enable to obtain a common mode choke coil having high impedance and small variation, and hence is industrially useful.

The invention claimed is:

1. A common mode choke coil comprising:

a magnetic core having a winding core part and a pair of flange parts provided on opposite ends of the winding core part;

external electrodes on each of the flange parts;

a pair of windings wound on the winding core part, the pair of windings each having the ends each being drawn out and joined to a corresponding one of the external electrodes; and a magnetic plate joined to the pair of flange parts with an adhesive, wherein the magnetic plate has joining parts joined to the flange parts and an opposing part opposing the winding core part, irregularities are disposed on the opposing part facing the pair of windings wound on the winding core part, and surface roughness of the joining parts is smaller than the irregularities of the opposing part facing the pair of windings.

2. The common mode choke coil according to claim 1, wherein thicknesses of the joining parts are thinner than a thickness of the opposing part.

3. The common mode choke coil according to claim 1, wherein a radius of curvature of corners of the magnetic plate that oppose the flange parts is smaller than a radius of curvature of corners of the flange parts that oppose the magnetic plate.

4. The common mode choke coil according to claim 1, wherein a plurality of trenches extending in an extending direction of the winding core part are provided in a face of the opposing part that opposes the winding core part.

* * * * *